United States Patent [19]

Kliethermes, Jr. et al.

[11] Patent Number: 4,996,813

[45] Date of Patent: Mar. 5, 1991

[54] SOUND BLOCK

[76] Inventors: John C. Kliethermes, Jr., 2212 Beam, Maplewood, Minn. 55019; Michael E. Woolfford, 3476 Jamacia Ave. North, Lake Elmo, Minn. 55042

[21] Appl. No.: 410,282

[22] Filed: Sep. 21, 1989

[51] Int. Cl.[5] ..... E04C 1/10

[52] U.S. Cl. ..... 52/593

[58] Field of Search ..... 52/589–595, 52/102, 284–286, 438, 442; 47/33; 446/122

[56] References Cited

U.S. PATENT DOCUMENTS

| | | | |
|---|---|---|---|
| 89,075 | 4/1869 | Reed | 52/607 |
| 1,142,471 | 6/1915 | White | 446/122 |
| 1,474,779 | 11/1923 | Kammer | 52/608 |
| 1,704,255 | 2/1929 | Lewis | 52/589 |
| 2,358,704 | 9/1944 | Goudy . | |
| 2,639,606 | 5/1953 | Boss | 52/589 |
| 2,708,329 | 5/1955 | McKee . | |
| 2,888,779 | 6/1959 | Hostetter | 52/270 |
| 2,942,115 | 6/1960 | O'Connell | 52/604 |
| 3,412,519 | 11/1968 | Brettingen | 52/593 |
| 3,897,164 | 7/1975 | Dodino | 52/574 |
| 3,996,715 | 12/1976 | Dowse | 52/593 |

FOREIGN PATENT DOCUMENTS

| | | | |
|---|---|---|---|
| 569898 | 8/1958 | Belgium | 52/595 |
| 844657 | 4/1969 | U.S.S.R. . | |

*Primary Examiner*—James L. Ridgill, Jr.
*Attorney, Agent, or Firm*—Hugh D. Jaeger

[57] ABSTRACT

A longitudinal sound block with eight sides or ten sides for use in concrete wall systems and reinforced wall systems. The sound block is used for sound barriers, privacy walls, and retaining walls. The front end of the sound block is a bullet-like nose. A rear end of the sound block receives the front end in a plane configuration or angled configuration.

9 Claims, 10 Drawing Sheets

SOUND BLOCK

BACKGROUND OF THE INVENTION

1. Field of the Invention

The present invention pertains to a masonry concrete block, and more particularly, pertains to an eight- or ten-sided concrete sound block and retaining wall.

2. Description of the Prior Art

The prior art blocks have not generally provided a sound block which is universal for end-to-end abutment, providing for various geometrical configurations and positive interlocking end-to-end.

Prior art sound walls, retaining walls or privacy walls have included use of timbers, steel and/or concrete usually placed by large, heavy equipment.

When used as a retaining wall inlet, the sound block overcomes problems of existing walls which when laid upon GeoGrid, introduces gaps between units and does not provide positive connection to resist pull out GeoGrid.

The present invention overcomes the disadvantages of the prior art by providing a sound block with eight sides or ten sides. The blocks are also properly aligned end-to-end due to interlocking end. The block is capable of providing geometrical configuration which increases wall strength to loads imposed. Changes to wall alignment increases section modules and resistance to overturning loads imposed.

SUMMARY OF THE INVENTION

The general purpose of the present invention is to provide a longitudinal sound block with eight sides or ten sides where the ends of the sound block mate with respective ends of the sound block on either side.

According to one embodiment of the present invention, there is provided a corresponding sound block including a three-sided front end two sides, and a three-sided or five-sided rear end. The ends are symmetrical with respect to each other. Longitudinal length is not dependant on width. The block has an appropriate height. The block can be dry stacked, pinned, or reinforced as required depending upon the height of the wall.

The block can include the recess on the longitudinal top plane for placement of GeoGrid layer for reinforced tiebacks. The holes of the block can align vertically for full height of wall to insure continuous reinforcing of wall from top to bottom. This also allows connection of wall units to footing by post tensioning capabilities extending from top of wall to footing. The blocks interlock end-to-end to create straight alignments, 45 degree change in alignment, 90 degree corners, and circular or serpentine alignment. Also, the sound block provides grooves for GeoGrid to be laid in to insure no gaping of units, vertical connection of units which compresses units together and clamps GeoGrid between blocks to resist pullout. Further, the sound block can use a post tensioning system for the top of the wall to a footing to insure reinforcement vertically which allows transfer to lateral forces into footing.

Significant aspects and features of the present invention include an eight-sided or ten-sided sound block, particularly a block which can be mass produced by a concrete masonry block machine.

Another significant aspect and feature of the present invention is a sound block which can be used for sound barriers, large retaining walls, and partition walls. The block can include recess groove or grooves for GeoGrid interconnection to wall, vertically aligned holes top to bottom to provide for flexible connection therebetween, and end-to-end interconnection which restrains differential movement of units in same plane.

Having thus described the embodiments of the present invention, it is a principal object hereof to provide an eight-sided or ten-sided sound block with bullet like ends and a longitudinal length.

One object of the present invention is a concrete sound block which is for sound barriers, large retaining walls, partition walls, or privacy walls. Other uses include small landscaping for providing relief to level grades, borders, privacy walls, tree rings, major retaining walls, sound barriers and protection/privacy barricades. The sound block can be used as a large sound barrier wall to 30 feet in height.

Other objects of the present invention include a sound block which provides an economical alternative to cast concrete, wood or metal sound barriers which are now standard construction. The block when combined in a system provides the permanence and sound absorbing qualities of concrete which are not found in existing timer or steel constructed systems. The sound block, due to its modular construction, can be installed on terrains which require substantial excavation for normal concrete construction, with minimal excavating and capable of stepping up or down grade.

The sound block is dry laid and eliminates the need for masons or mortar. The sound block can be installed using hand labor or larger equipment.

Height of wall is infinite as it can be dry-stacked to heights of 15 feet without additional reinforcing, or as height increases, using post tensioning methods to form the wall together from top and bottom.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
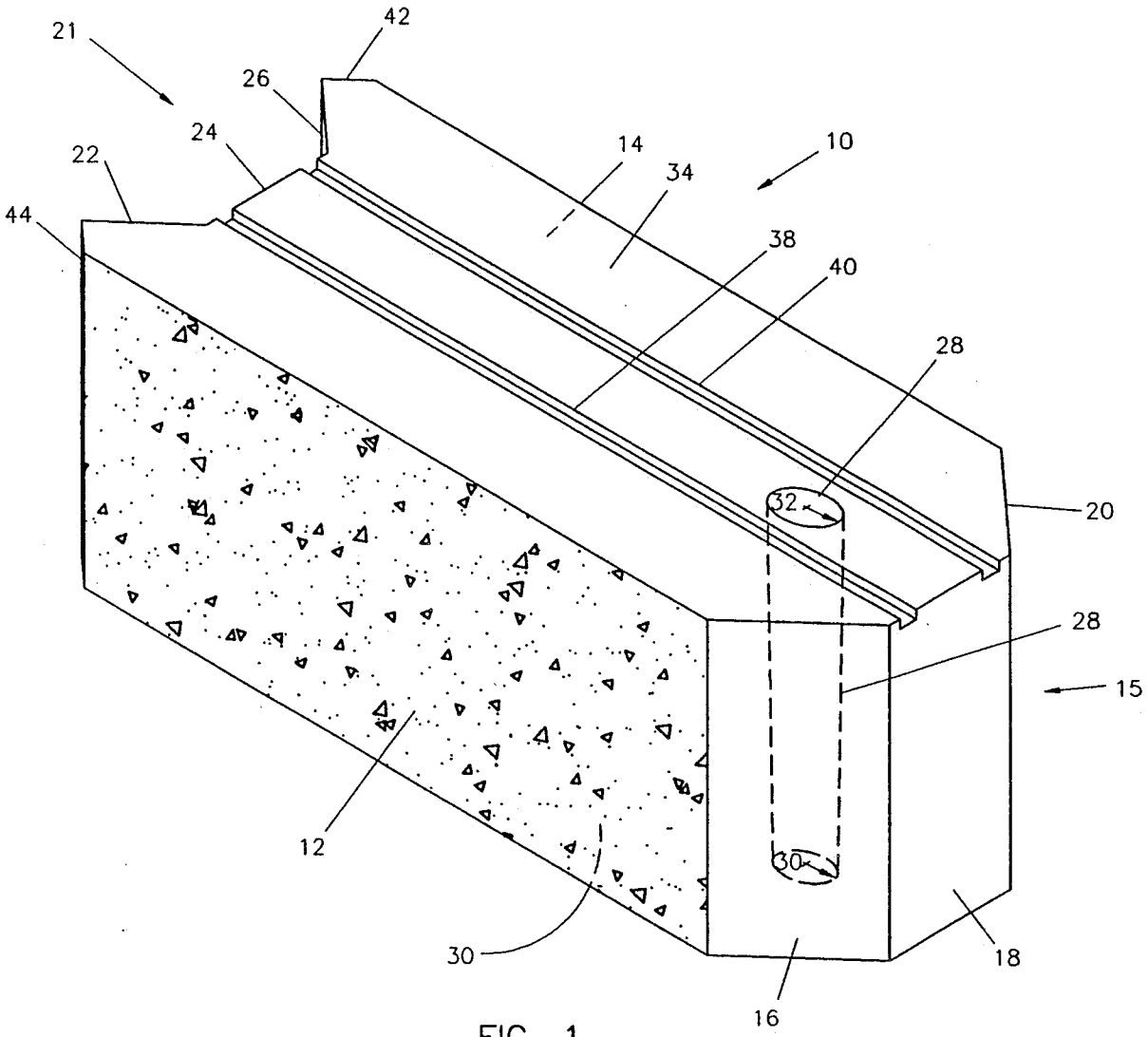
FIG. 1 illustrates a perspective view of a sound block, the present invention.

FIG. 1 illustrates a perspective view of a sound block 10, the present invention, including longitudinal sides 12 and 14, a bullet-like front 15 including three end members of equal length sides 16, 18 and 20, and a reverse bullet-like end 21 including three end members of equal length sides 22, 24, and 26. Side 24 is substantially equal to the length of side 16, 18 or 20 of the bullet-like front 15 for mating purposes such as described and illustrated in FIGS. 5 and 9. The reverse bullet-like end 21 accommodates the bullet-like front 15 of an adjacent block as described later in detail. The sound block 10 includes a pivot hole 28 with a bottom radius 30 and a top radius 32 extending between a top surface 34 and a bottom surface 36. Optional parallel longitudinal grooves 38 and 40 in the top face of the block are recessed into the top surface 34 for GeoGrid and extend between bullet-like front 15 and reverse bullet-like end 21. The reverse bullet-like end 21 also includes optional chamfered surfaces 42 and 44 between sides 14 and 26 and sides 12 and 22, respectively. Chamfered surfaces 42 and 44 on the end members form decorative mortar grooves 45 such as between chamfered surface 44 and equal length side 16 of a sound block 10 aligned end-to-end with another sound block 10 as illustrated in FIG. 4.

Figure 2:
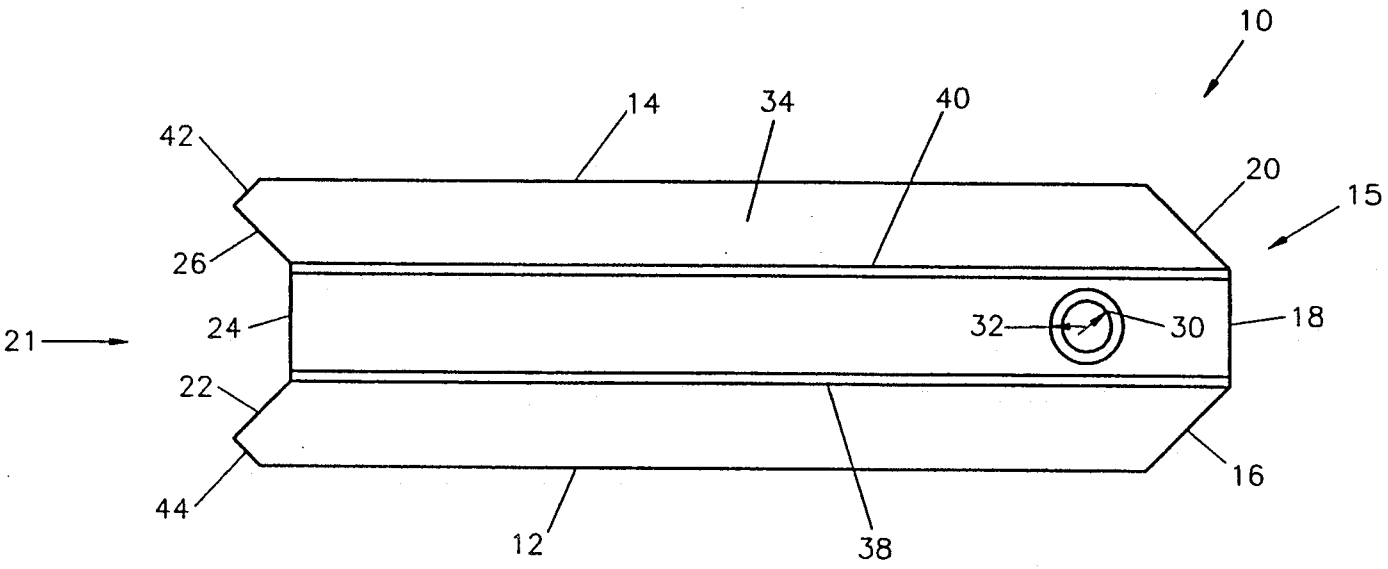
FIG. 2 illustrates a top view of a sound block, the present invention.

FIG. 2 illustrates a top view of the sound block 10 where all numerals correspond to those elements previously described.

Figure 3:
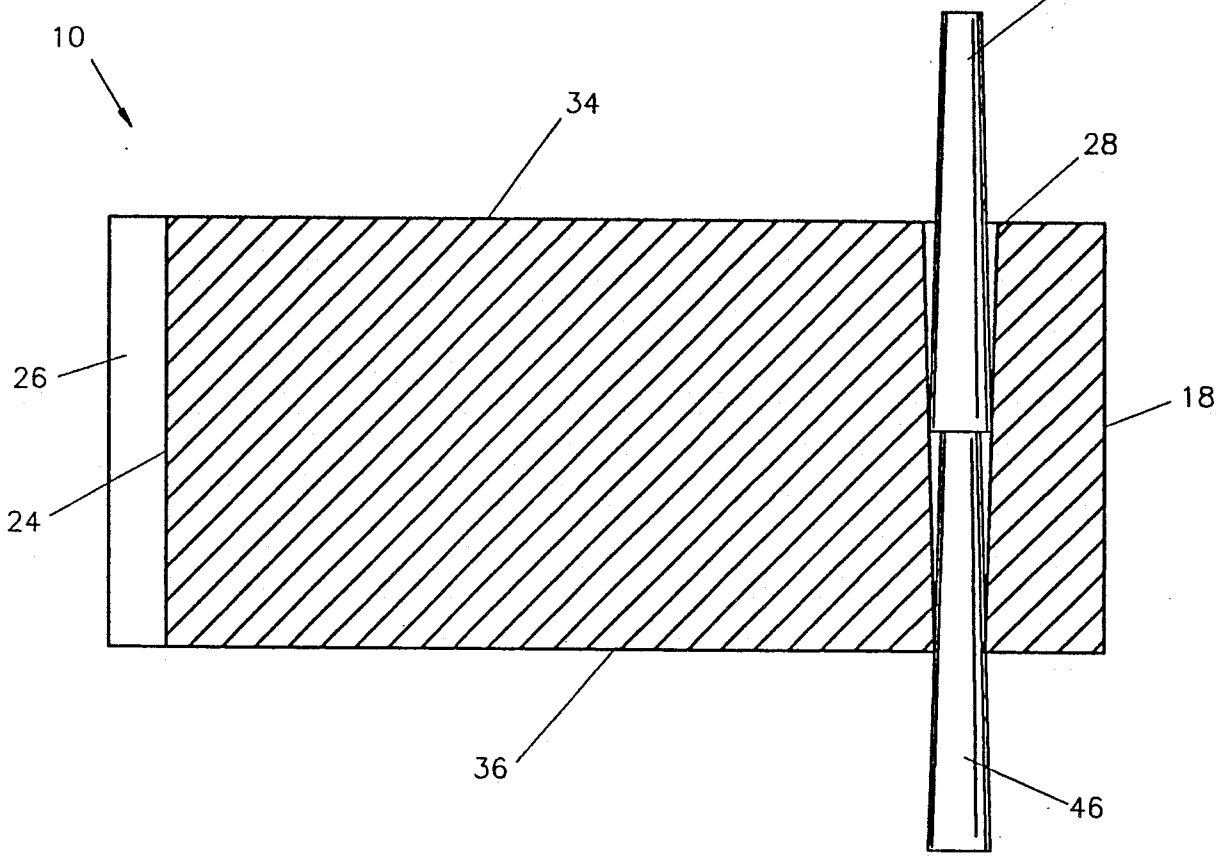
FIG. 3 illustrates a side view of the sound block.

FIG. 3 illustrates a side view of the sound block 10 in partial cross section where all numerals correspond to those elements previously described. Similar concrete pin 46 with decreasing diameters are illustrated in the pivot hole 28. The pin 46 is inversely positioned to provide for connection of the blocks in a horizontal plane.

Figure 4:
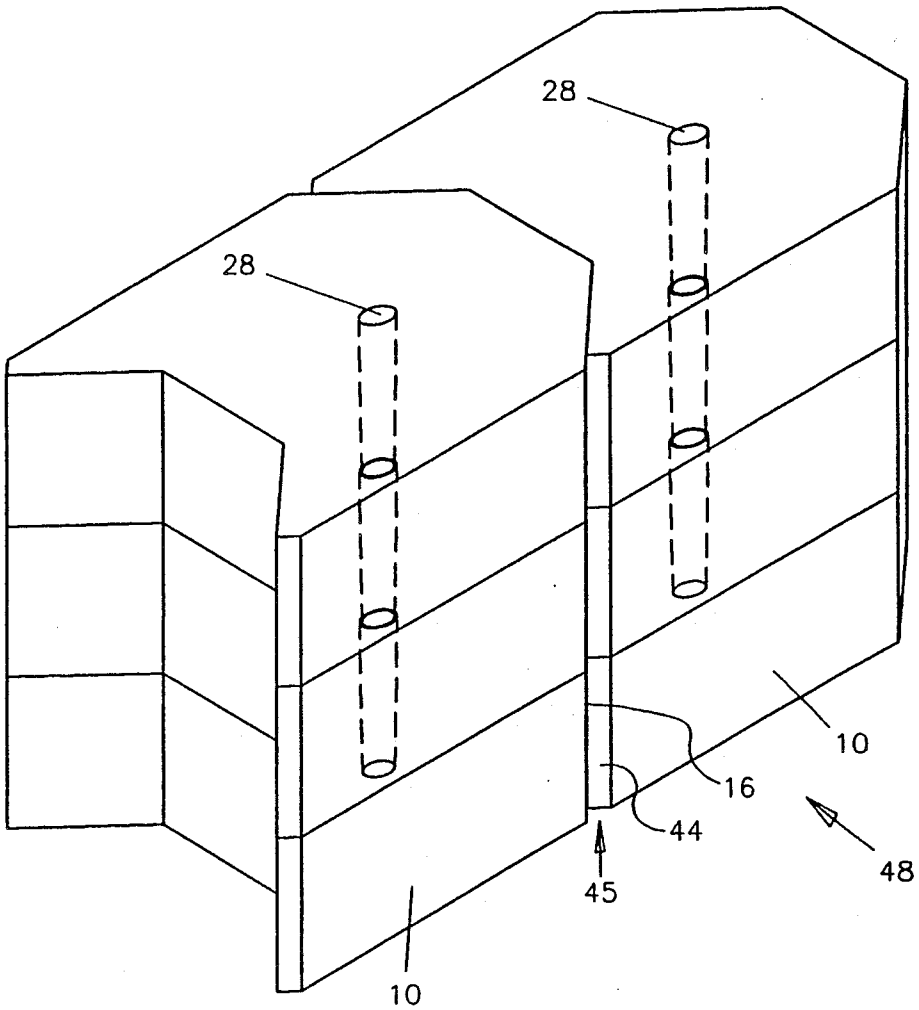
FIG. 4 illustrates connection of the blocks to form a retaining wall.

FIG. 4 illustrates connection of the blocks 10 to form a retaining wall 48 where a plurality of blocks 10 are aligned vertically, one directly above the other and pinned with the concrete pins 46 between the blocks in a manner as illustrated in FIG. 3. A continuous decorative mortar groove 45 is formed vertically between the columns of vertically aligned blocks.

Figure 5:
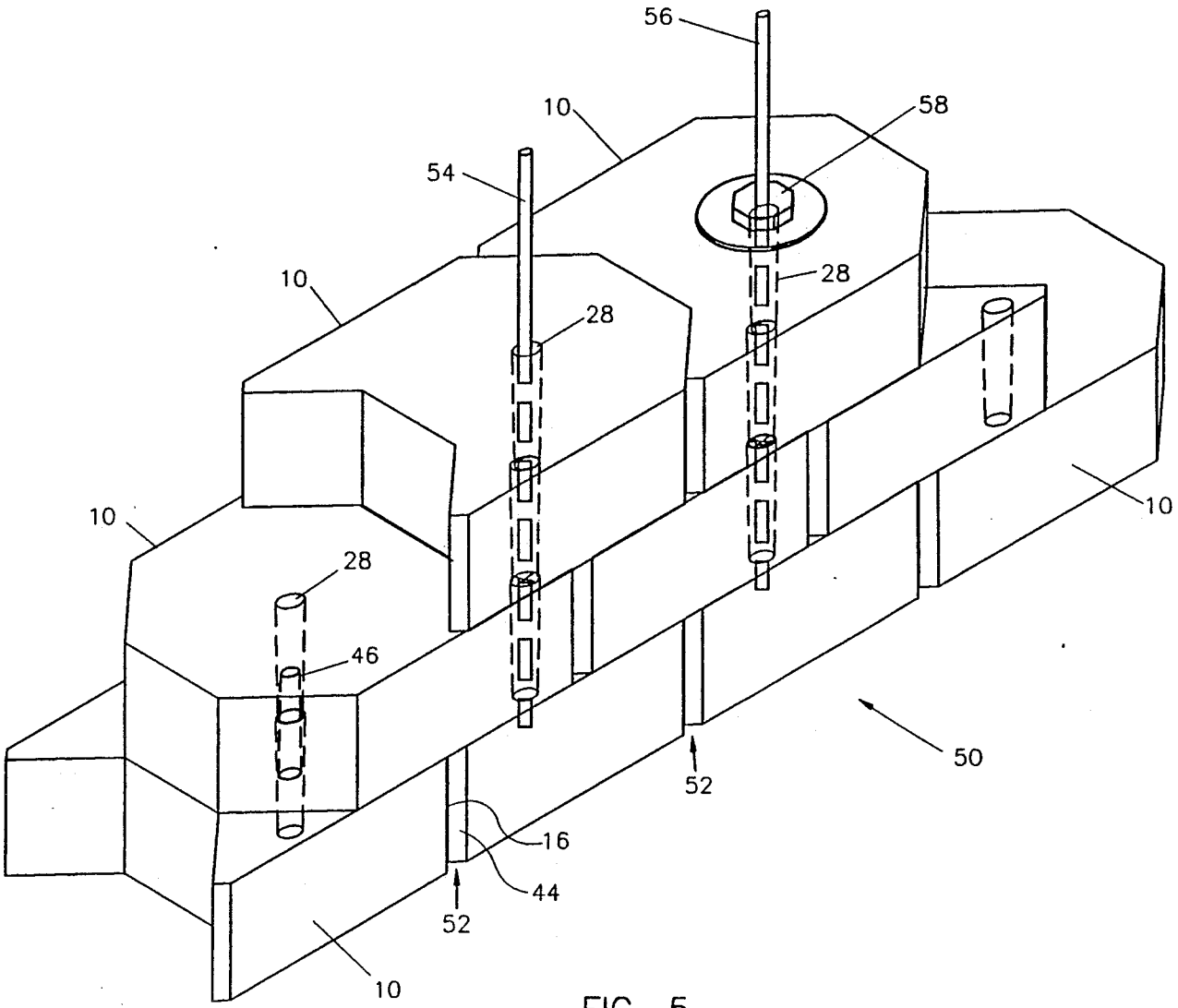
FIG. 5 illustrates a post tensioned sound block wall.

FIG. 5 illustrates connection of the blocks 10 to form a retaining wall 50 where alternative rows of blocks 10 are placed in longitudinal configuration facing opposite directions. Short decorative mortar grooves 52 are formed which alternate vertically. The blocks can also be pinned such as with an anchored cable 54 or rod 56, each of which may be tensioned vertically along and through the blocks to secure the retaining wall in a vertical fashion by a tension tightening device such as a nut 58 or other appropriate fastener.

Figure 6:
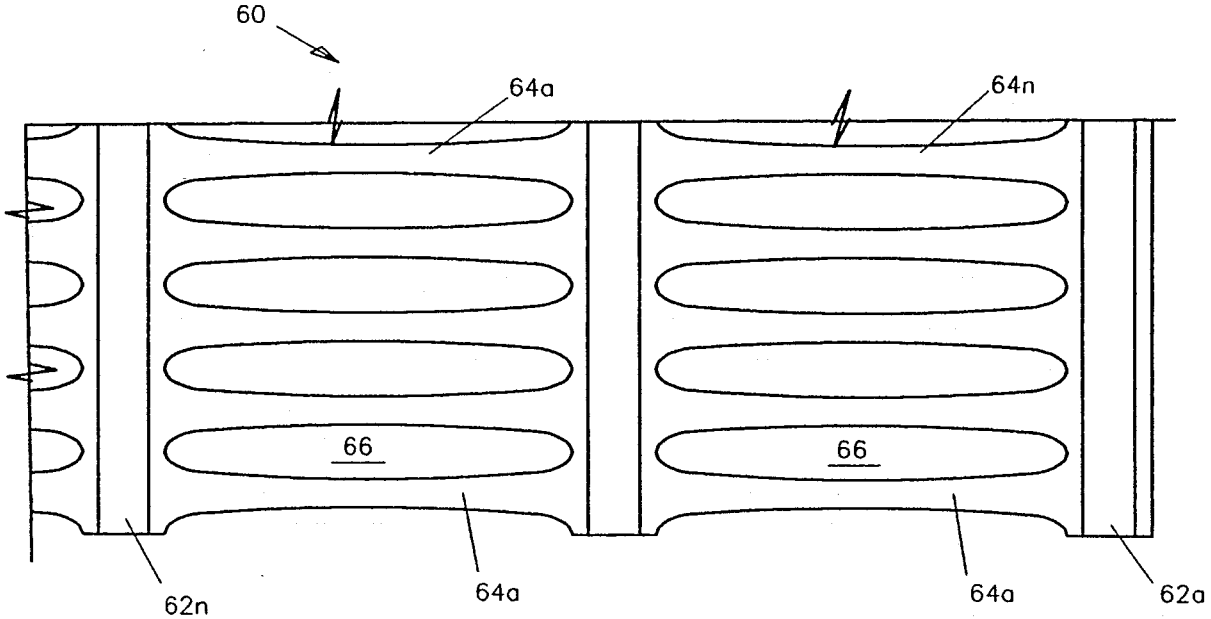
FIG. 6 illustrates a grid lock web.

FIG. 6 illustrates a grid lock web 60 known as GeoGrid of a polymer or other material for anchoring a block wall to the earth for additional stability. The grid lock web 60 includes a plurality of longitudinal stringers **62*a*–62*n* and a plurality of perpendicular smaller and thinner lateral stringers 64*a*–64*n* connecting to and between the longitudinal stringers 62*a*–62*n*. A plurality of oblong holes 66 position between the stringers 62*a*–62*n* and 64*a*–64*n* to capture the earth for the purpose of anchoring a wall as illustrated in FIG. 8**.

Figure 7:
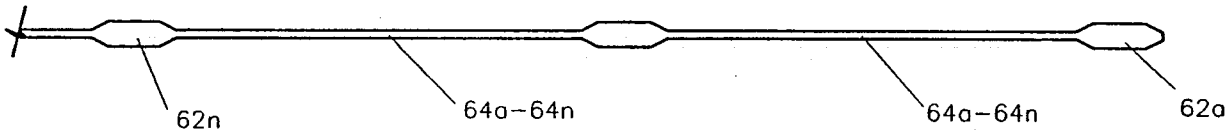
FIG. 7 illustrates an end vieW of the grid lock web.

FIG. 7 illustrates an end view of the grid lock web 60 where all numerals correspond to those elements previously described.

Figure 8:
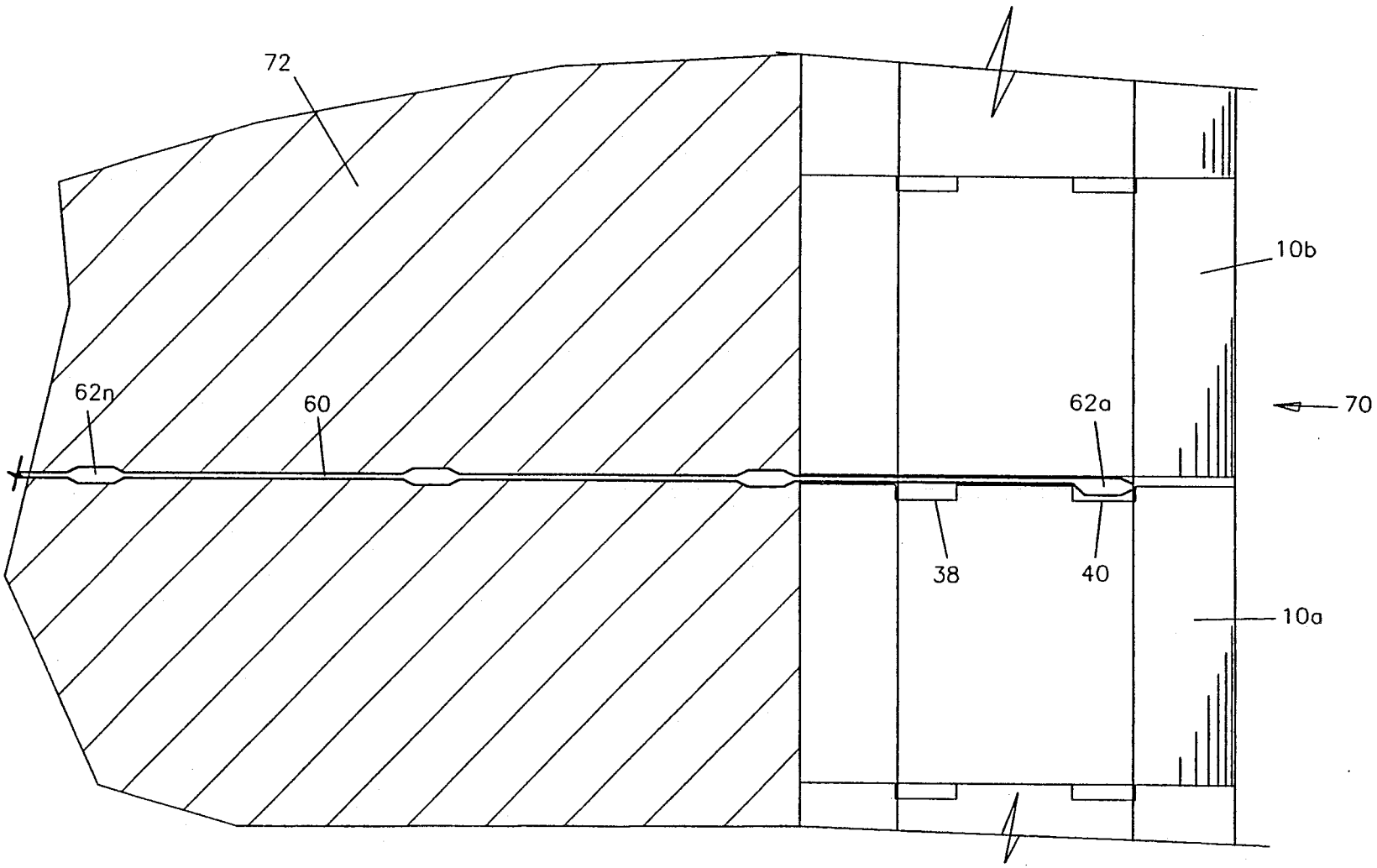
FIG. 8 illustrates a wall comprised of blocks anchored to the earth by a grid lock web.

FIG. 8 illustrates a wall 70 comprised of blocks 10 anchored to the earth 72 by the grid lock web 60 where all numerals correspond to those elements previously described. The longitudinal stringer **62*a* is captured and compressed in the optional parallel longitudinal groove 40 of block 1O*a* by block 10*b* overhead. The grid lock web 60 can be of any suitable length as desired to insure proper anchoring of the wall. Any number of grid lock webs can be used at different levels to insure sufficient wall stability. The blocks 10** are also pinned as previously described.

Figure 9B:
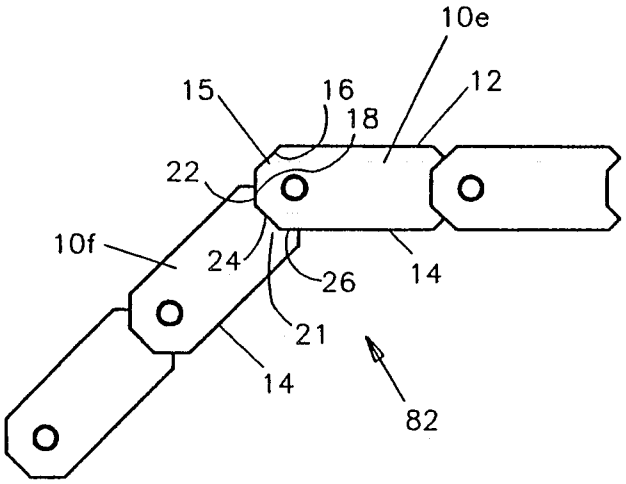
FIGS. 9A, 9B and 9C illustrate top views of different geometrical stacking arrangements.
Figure 9A:
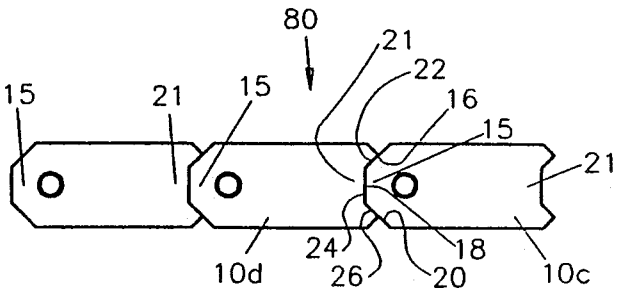
Figure 9C:
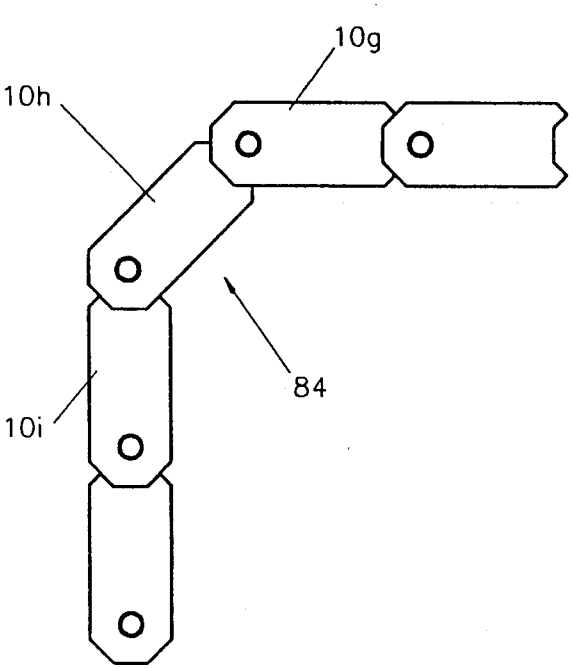

FIGS. 9A, 9B and 9C illustrate top views of different vertical geometrical stacking arrangements.

FIG. 9A illustrates a straight wall 80 comprised of similar blocks 10 arranged in an end-to-end manner where successive bullet-like front 15 are accommodated by successive reverse bullet-like ends 21. Specifically, side 18, one of the three equal sides, mates with the substantially equal side 24 of block **10*d*. Sides 16 and 20 of block 10*c* nest against sides 22 and 26 of block 10*d*. It is appreciated that the previously described surfaces are octagonal shaped or at least are portions thereof which facilitates fitting of the blocks as now described in FIG. 9B**.

FIG. 9B illustrates a 45° angle wall 82 where bullet-like front 15 and reverse bullet-like end 21 of blocks **10*e* and 10*f* are mated. Substantially equal length sides 20 of block 10*e* and 24 of block 1O*f* are mated. Side 22 of block 10*f* and part of side 18 of block 10*e* are mated, and side 26 of block 10*f* and part of side 14 of block 10*c*** are mated again using the qualities of the partial octagonal shape design of the end structures.

FIG. 9C illustrates a wall 84 angled at 90°. Blocks **1O*g* and 10*h* have been arranged as described in FIG. 9B where block 10*h* forms the transitional link between a similarly arranged block 10*i* and the block 1O*g***.

Figure 10:
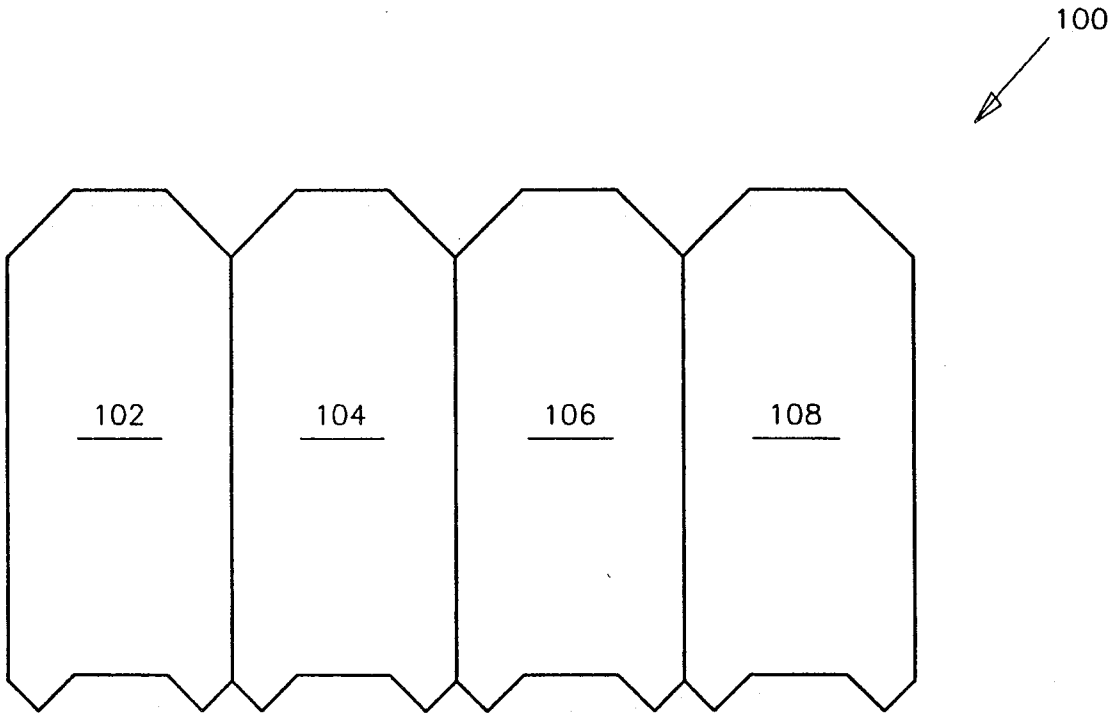
FIG. 10 illustrates a configuration of blocks as joined together at the time of manufacture and prior to separation of the blocks into individual blocks; and, FIG. 11 illustrates an eight-sided sound block.

FIG. 10 illustrates a block form 100. A plurality of blocks are formed as a single unit such as connected blocks 102–108, and later divided into separate blocks 102–108 such as by splitting.

Figure 11:
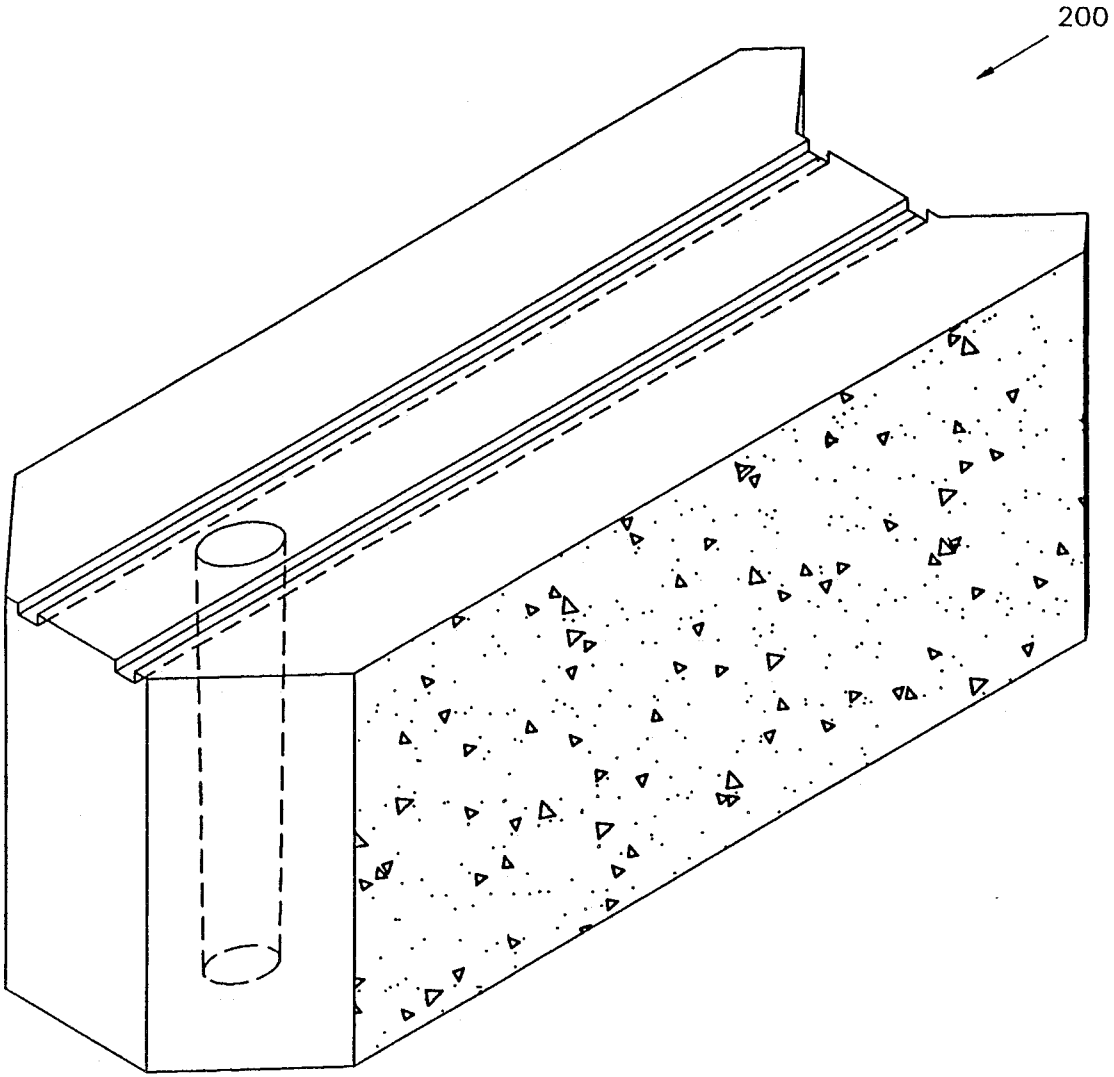

FIG. 11 illustrates a perspective view of an eight-sided concrete block 200.

Various modifications can be made to the present invention without departing from the apparent scope hereof.

I claim:

1. A retaining wall privacy sound block comprising:

a. two opposing sides;

b. a front end with three members of substantially equal length sides including a bullet-like nose;

c. a rear end with three end members of equal length to receive the front end of a corresponding like block;

d. chamfered outer end for each of said rear opposing end member;

e. two opposing longitudinal grooves in a top face for accepting a grid structure for extending beyond one of said sides of said block; and, f. at least one hole extending through said block whereby said retaining wall privacy sound block can be stacked and mated with like corresponding blocks.

2. A block of claim 1 wherein said block is a sound block.

3. A block of claim 1 wherein said block is a retaining wall block.

4. A block of claim 1 wherein said block is a privacy wall block.

5. A block of claim 1 wherein said block is a commercial block.

6. A block of claim 1 wherein said block is a consumer block.

7. A block of claim 1 wherein said block is of concrete.

8. A block of claim 1 wherein said block is of a composite concrete material.

9. A retaining wall privacy sound block comprising:

a. two opposing sides;

b. a front end with three members of substantially equal length sides including a bullet-like nose;

c. a rear end with three end members of equal length to receive the front end of a corresponding like block;

d. chamfered outer end for each of said rear opposing end member;

e. two opposing longitudinal grooves in a top face for accepting a grid structure for extending beyond one of said sides of said block; and, f. at least one post tensioning hole extending through said block for tensioning a plurality of stacked blocks with a rod whereby said retaining wall block can be stacked and mated with like corresponding blocks in adjacent interlocking courses with opposing sides.

* * * * *